United States Patent [19]

Orsinger et al.

[11] 4,344,729

[45] Aug. 17, 1982

[54] BREAK-AWAY DEVICE

[75] Inventors: Winston A. Orsinger, Nazareth; George Fallos, Easton, both of Pa.

[73] Assignee: Bell and Howell Company, Phillipsburg, N.J.

[21] Appl. No.: 120,014

[22] Filed: Feb. 8, 1980

[51] Int. Cl.[3] ..... B65H 3/32; B66C 1/42

[52] U.S. Cl. ..... 414/226; 414/730; 414/732; 294/104; 74/527; 74/531; 81/478; 271/268

[58] Field of Search ..... 414/730, 732, 736, 738, 414/225, 226; 294/104; 271/268, 85; 74/527, 531, 524, 547; 81/467, 478, 472

[56] References Cited

U.S. PATENT DOCUMENTS

| | | | |
|---|---|---|---|
| 266,947 | 10/1882 | Zerfas . | |
| 871,110 | 11/1907 | Comings . | |
| 1,928,487 | 9/1933 | Hammerly | 74/547 X |
| 2,325,455 | 7/1943 | Williams | 53/57 |
| 2,511,734 | 6/1950 | Murphy . | |
| 2,554,969 | 5/1951 | Williams . | |
| 3,060,763 | 10/1962 | Neufeld et al. | 74/524 |
| 3,561,281 | 2/1971 | Wilfert . | |
| 3,659,329 | 5/1972 | Walker . | |
| 4,121,483 | 10/1978 | Sedlock | 74/479 |

FOREIGN PATENT DOCUMENTS

| | | | |
|---|---|---|---|
| 407362 | 10/1944 | Italy | 81/478 |

*Primary Examiner*—Charles A. Marmor

*Attorney, Agent, or Firm*—Griffin, Branigan & Butler

[57] ABSTRACT

A break-away device includes a lower arm 15 pivotally connected to an upper arm 19 by a coupling 17. The lower and upper arms 15,19 are generally maintained in a rigid, colinear relationship by a spring-biased detent pin 39. When the lower arm 15 undergoes a lateral impact, the detent pin 39 is displaced from a grooved detent recess 37 of the lower arm 15 and rolled about an upper convex surface 31 thereof, thereby permitting the lower arm 15 to pivot about the coupling 17 and break away from the upper arm 19.

7 Claims, 4 Drawing Figures

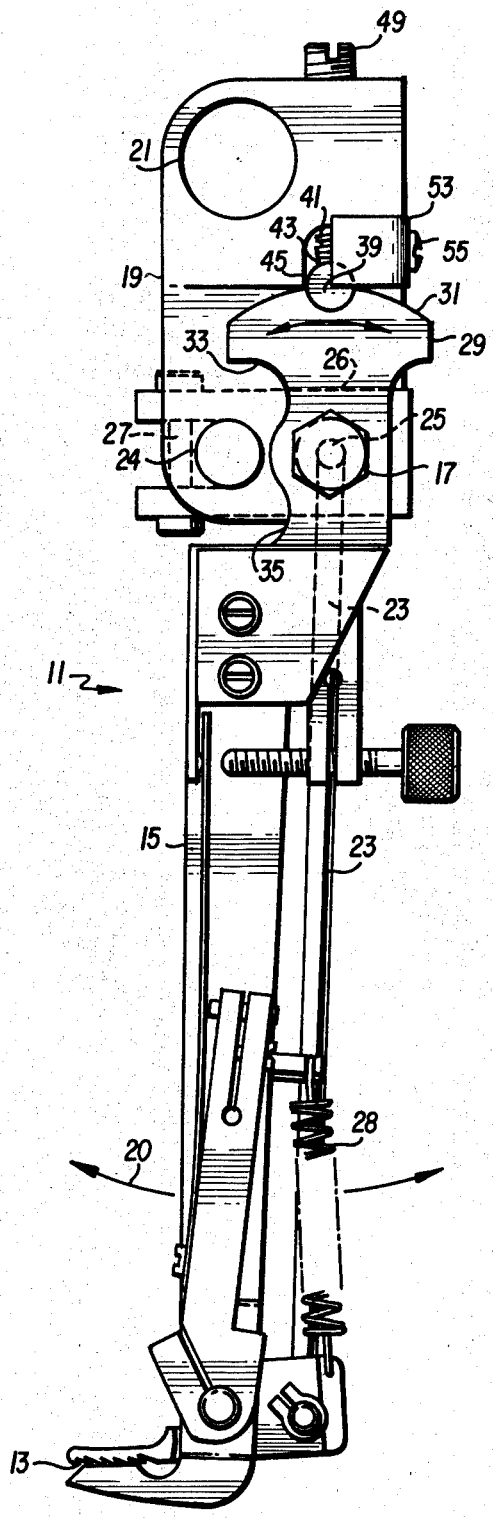
FIG. 1
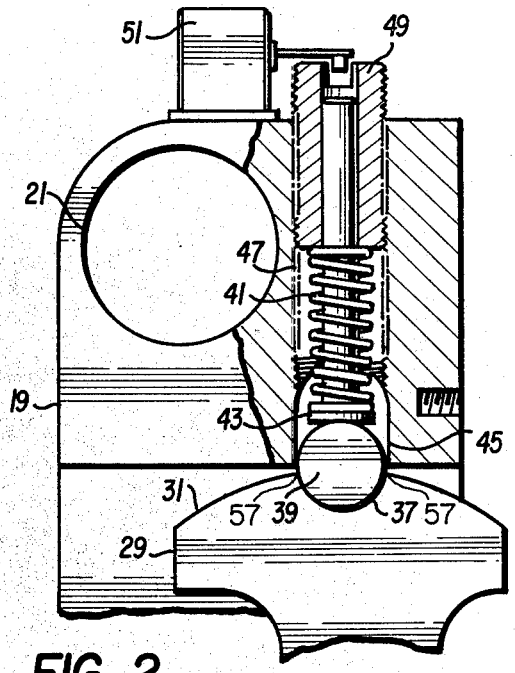
FIG. 2
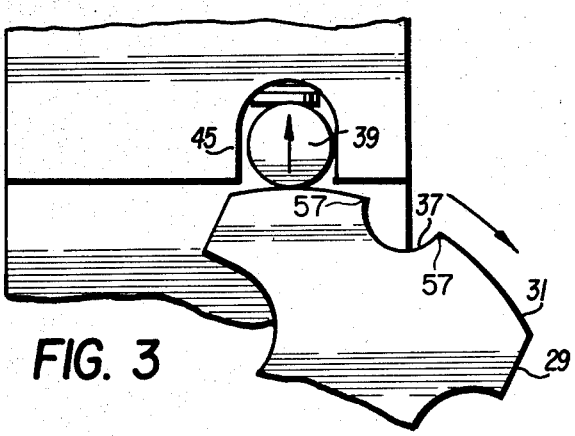
FIG. 3
FIG. 4
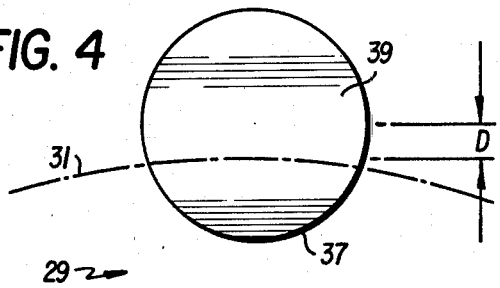

BREAK-AWAY DEVICE

BACKGROUND OF THE INVENTION

This invention pertains to break-away devices and has particular relevance to the utilization of such devices in a gripper arm assembly of an inserting machine.

In serting machines, such as that disclosed in U.S. Pat. No. 2,325,455 to A. H. Williams (incorporated herein by reference), gripper arms having gripper jaws are employed to extract pieces of insert material from supply stations and to deposit the extracted pieces on a transport means. In this respect, a plurality of gripper arms, each associated with a particular station, are simultaneously swung toward the supply stations by the rotation of a first shaft common to all the gripper arms. A second shaft (also common to all the gripper arms) then rotates and, through the operation of a crank disc and a control rod, thereby causes the gripper jaws at each station to engage a piece of insert material. The first shaft is then oppositely rotated so that the gripper arms extract the pieces. Lastly, the second shaft is oppositely rotated so that the jaws disengage the pieces of material and deposit the same on the transport means.

On infrequent occasion pieces of material may jam occur at a supply station. An operator may endeavor to rectify the jam by using either his hand or a tool to retrieve the jammed piece of material. Since gripper arms such as those described above generally are quite durable and operate with great rapidity, correction of a jam in this manner presents several potential problems. First, should an operator interpose his hand into the path of the gripper arm to retrieve the jammed piece, there is a possibility that the swift, rigid gripper arm would injure the operator's hand, arm, or wrist. Secondly, should an operator interpose a tool, there is a further possibility that the tool may damage the gripper arm.

Therefore, an object of this invention is to provide a break-away device that temporarily yields upon impact. Break-away devices per se are not new and are of many diverse types. One such break-away device is illustrated in U.S. Pat. No. 3,561,281 to Wilfert, which discloses a floor-mounted automobile stick shaft having a coupling positioned on an inclined plane between two shaft portions with a spring-loaded ball locking the coupling in place. The coupling yields when the stick shift is subjected to a shock-like load along its longitudinal axis.

Existing break-away devices, including the Wilfert device, do not break-away under lateral impact so as to prove compatible with the operation of an inserting machine. Therefore, an advantage of this invention is the provision of a gripper jaw assembly having a gripper arm that temporarily breaks away upon lateral impact. Accordingly, the invention advantageously promotes shop safety and prevents damage to costly machinery.

SUMMARY

The present break-away device remains rigid during normal operation but temporarily yields upon lateral impact. The break-away device includes a lower arm pivotably connected by a coupling to an upper arm. Rotational movement of the lower arm with respect to the upper arm is generally precluded by a detent pin which normally rests in a grooved detent recess on the lower arm. However, when the lower arm suffers an impact with a relatively resistant body, the detent pin is displaced from the grooved recess and rolls along an upper convex surface of the lower arm, thereby permitting the lower arm to pivot about the coupling.

In one embodiment of the invention, a detent pin is resiliently biased toward the lower arm by a helical spring housed in a recess of the upper arm. When the lower arm suffers a lateral impact, the detent pin pushes the helical spring and a plunger associated therewith through the recess until the plunger contacts a limit switch, thereby terminating the operation of the machinery comprising the break-away device. This embodiment of the invention is advantageously incorporated into inserting machines.

BRIEF DESCRIPTION OF THE DRAWINGS

The foregoing objects and many of the attendant advantages of this invention will become more readily appreciated as the same becomes better understood by reference to the following detailed description of a preferred embodiment of the invention when taken in conjunction with the accompanying drawings, wherein:

FIG. 1 is a partially schematic side elevation view of a gripper jaw of an inserting machine embodying the invention;

FIG. 2 is a fragmentary side sectional view of a gripper jaw with its detent device in normal operating engaged position;

FIG. 3 is a fragmentary side elevation view of a gripper jaw with its detent device in its disengaged position; and, FIG. 4 is a fragmentary side elevation view of a gripper jaw's detent device.

DESCRIPTION OF THE PREFERRED EMBODIMENT

FIG. 1 illustrates a gripper jaw assembly 11 with its gripping jaws 13 mounted on the end of a lower gripper arm 15. Lower gripper arm 15 is pivotally connected by a coupling, such as fastener 17, to an upper gripper arm 19. In this respect, fastener 17 first protrudes through lower gripper arm 15 with sufficient tolerance to allow arm 15 to rotate thereabout and then is threadedly engaged with the upper gripper arm 19.

The entire gripper jaw assembly 11 rotates about a first reciprocating shaft passing through an aperture 21 in the upper gripper arm 19. In this respect, the gripper jaw assembly 11 alternately rotates in the clockwise and counterclockwise direction as depicted by arrow 20. When rotated toward the left of FIG. 1, the gripper jaw assembly 11 approaches a supply station (not shown).

The gripper jaws 13 are connected to an actuating rod 23 which, in turn, is ultimately connected to a second reciprocating shaft passing through an aperture 24 in the upper gripper arm 19. In particular, an upper pivot center 25 of the actuating rod 23 protrudes through a corresponding aperture in a crank disc 26. A threaded fastener 27 affixes the crank disc 26 to the second reciprocating shaft so that the shaft and the jaws coact basically in the manner described in the aforementioned Williams patent. The gripper jaw 13 are also attached to a helical spring 28 which is mounted at the lower end of the lower gripper arm 15.

An upper end of the lower gripper arm 15 is formed as a break-away head 29 having an upper convex surface 31. On the side of the break-away head 29 proximate the supply station are two limit stops—an upper concave limit stop 33 and a lower concave curve limit stop 35.

As can be seen in FIGS. 2 and 4, the upper surface 31 of the break-away head 29 has a curved detent recess 37 fitted to receive a key member, or detent pin 39. The detent pin 39 is held in position in the curved detent recess 37 as a helical spring 41 which exerts pressure on the detent pin 39 through a plunger pin 43.

As shown in FIGS. 2 and 3, an inverted U-shaped recess 45 of a dimension slightly larger than the diameter of the detent pin 39 is cut through the upper gripper arm 19 to potentially accommodate substantially the entire detent pin 39. A drilled and threaded hole 47 through the top of the upper gripper arm 19 houses the helical spring 41 and its plunger pin 43. Tension on the helical spring can be varied by an adjusting cap screw 49 which has been drilled through its center to receive a distal end of the plunger pin 43.

A limit switch mechanism 51 is mounted on top of the upper gripper arm 19 and positioned so as to contact the distal end of the plunger pin 43 when it is momentarily elevated by the detent pin 39.

A cover plate 53 secured to the upper gripper arm 19 by a machine screw 55 as illustrated in FIG. 1, laterally retains the detent pin 39 in the U-shaped recess 45 of the upper gripper arm 19.

In operation, the entire gripper arm assembly reciprocates back and forth in the direction of arrow 20 as described above. The lower gripper arm 15 and upper gripper arm 19 move together as a single, rigid unit when the detent pin 39 is held in the detent recess 37.

When a relatively resistant body laterally impacts any point on arm 15 below fastener 17, a torque is created about fastener 17 which exerts a force on the detent pin 39. The force is initially transmitted to the detent pin 39 by one of the corners 57 of the detent recess 37 (depending on the side of the assembly where the impact occurs). At the corner 57 the force is essentially resolved into a first component tangent to the recess 37 and a second component normal to the tangent, the resultant having the effect of forcing the detent pin 39 up out of its curved detent recess 37 and into the inverted U-shaped recess 45. Thereafter the detent pin 39 housed in recess 45 rides on the upper surface 31 of the break-away head 29 as shown in FIG. 3, thereby allowing the lower gripper arm 15 to pivot about the break-away pivot 17.

The lower gripper arm 15 will continue its pivotal movement until either of the curved limit stops 33 or 35 on the side of break-away head 29 engage the second reciprocating shaft passing through the aperture 24. Upon contact with the shaft in this manner the pivotable movement of the lower gripper arm 15 stops. Thus, the lower gripper arm 15 is precluded from rotating beyond a prescribed angle of rotation. Advantageously this eliminates the possibility of the lower arm 15 striking any other machinery, such as a supply station, or of the detent pin 39 rolling completely off the break-away head 29 and being lost in the machinery.

As the detent pin 39 moves upwardly, it compresses the helical spring 41 and forces the plunger pin distal end upward through the adjusting cap screw 49 to contact the limit switch mechanism 51, which in turn shuts off the inserting machine.

The fastener 17, which serves as the breakaway pivot point, preferably coincides with the upper pivot center 25 of the jaw actuating rod 23 in order for the lower gripper arm 15 to rotate about the pivot point 17 in an unrestricted manner.

The distance D indicated in FIG. 4 is dependent upon the diameter of the detent pin 39 (which is essentially equal to the curvature of the detent recess 37) and the radius of curvature of the upper convex surface 31. The distance D is related to the desired break-away force range needed to force the detent pin 39 up against its biased plunger pin 43 and out of its recess 37. The illustrated embodiment has a "D" value of 0.016 inch, but the "D" value may peferably lie in a range between 0.005 and 0.500 inches. Also, the break-away device may be set to break away at a given resistant force within a given range by adjusting the cap screw 49 to either increase or decrease the compressive force exerted by the helical spring 41 on the plunger pin 43 to keep the detent pin 39 in position in the curved detent recess 37.

While the invention has been particularly shown and described with reference to the preferred embodiment, it will be understood by those skilled in the art that various modifications and substitutions may be made in the described embodiment such as employing the break-away device on floor-mounted gear shift levers or backhoe digger arms without departing from the spirit and scope of the appended claims.

The embodiments of the invention in which an exclusive property or privilege is claimed are defined as follows:

1. A gripper jaw assembly suitable for clockwise and counterclockwise rotation to and from a supply station of an inserting machine, said assembly comprising:

an upper gripper arm having a top portion and a bottom portion, said upper gripper arm being rotatable about an axis passing therethrough;

a lower gripper arm having a top portion, a bottom portion, a front side, and a back side, said front side facing said supply station and said back side being opposite thereto, said lower gripper arm further having gripper jaws at said bottom portion thereof;

a coupling pivotally connecting the top portion of said lower griper arm to the bottom portion of said upper gripper arm; and, a key member positioned between said upper gripper arm and said lower gripper arm, said key member generally maintaining said upper gripper arm and said lower gripper arm in a substantially rigid, colinear relationship but enabling said lower gripper arm to rotate about said coupling and thereby out of said substantially colinear relationship when one of said sides of said lower gripper arm impacts a resistant body.

2. The assembly of claim 1 wherein said key member comprises a roller pin having a specified radius; wherein an upper surface of said lower gripper arm has formed therein a grooved recess of said specified radius for accommodating at least part of said roller pin; wherein said upper gripper arm has formed therein a recess, at least a portion of said upper gripper arm recess adapted to accommodate said roller pin, said upper gripper arm recess also containing a biasing means for resiliently urging said roller pin toward said upper surface of said lower gripper arm; and wherein said upper surface of said lower gripper arm is a curved convex surface for permitting said roller pin to roll thereon and for permitting said lower gripper arm to rotate about said coupling when an impact on one of said sides of said lower gripper arm forces said roller pin out of said upper surface grooved recess.

3. The apparatus of claims 2 wherein said upper surface of said lower gripper arm comprises an arc of a second specified radius, and wherein a distance D separating said upper surface of said lower gripper arm from said bottom portion of said upper gripper arm is related to the specified radius of said key member and to the second specified radius of said upper surface of said lower gripper arm.

4. The apparatus of claim 3 wherein said distance D is between 0.005 and 0.500 inch.

5. The apparatus of claim 2 wherein said biasing means comprises a helical spring mounted on a plunger pin.

6. The apparatus of claim 5 wherein said plunger pin has a distal end which contacts a switch mechanism to shut off the inserting machine when one of said side of said lower gripper arm impacts a relatively resistant body.

7. The apparatus of claim 1 wherein said upper gripper arm has passing therethrough a reciprocating shaft; and wherein said top portion of said lower gripper arm has on its front side at least one stop means for engaging said shaft so as to limit the rotation of said lower gripper arm about said coupling.

* * * * *